US006841492B2

(12) United States Patent
Bhatnagar et al.

(10) Patent No.: US 6,841,492 B2
(45) Date of Patent: Jan. 11, 2005

(54) BI-DIRECTIONAL AND MULTI-AXIAL FABRICS AND FABRIC COMPOSITES

(75) Inventors: Ashok Bhatnagar, Chester, VA (US); Elizabeth Stroud Parrish, Blackstone, VA (US)

(73) Assignee: Honeywell International Inc., Morristown, NJ (US)

( * ) Notice: Subject to any disclaimer, the term of this patent is extended or adjusted under 35 U.S.C. 154(b) by 203 days.

(21) Appl. No.: 10/179,715

(22) Filed: Jun. 25, 2002

(65) Prior Publication Data

US 2003/0228815 A1 Dec. 11, 2003

Related U.S. Application Data

(60) Provisional application No. 60/387,201, filed on Jun. 7, 2002.

(51) Int. Cl.[7] ..... D03D 15/08

(52) U.S. Cl. ..... 442/135; 442/134; 442/182; 442/206; 442/207; 442/209; 442/239; 442/246; 442/255; 442/261; 442/286; 442/290; 428/911; 28/140; 2/2.5

(58) Field of Search ..... 28/140; 428/911; 442/134, 135, 181, 239, 246, 255, 261, 286, 290, 210, 301, 304, 182, 206, 207, 209; 2/2.5

(56) References Cited

U.S. PATENT DOCUMENTS

| | | | | |
|---|---|---|---|---|
| 2,893,442 A | * | 7/1959 | Genin | 139/383 R |
| 4,403,012 A | | 9/1983 | Harpell et al. | 428/290 |
| 4,457,985 A | | 7/1984 | Harpell et al. | 428/224 |
| 4,501,856 A | | 2/1985 | Harpell et al. | 525/240 |
| 4,543,286 A | | 9/1985 | Harpell et al. | 428/288 |
| 4,563,392 A | | 1/1986 | Harpell et al. | 428/394 |
| 4,584,347 A | | 4/1986 | Harpell et al. | 525/119 |
| 4,613,535 A | | 9/1986 | Harpell et al. | 428/113 |

(List continued on next page.)

FOREIGN PATENT DOCUMENTS

| | | | |
|---|---|---|---|
| FR | 2443397 | 4/1980 | |
| WO | WO 91/12136 | 8/1991 | B32B/31/20 |

OTHER PUBLICATIONS

"Lightweight Composite Hard Armor Non Apparel Systems with T–963 dtex DuPont Kevlar 29 Fibre", E.I. Dupont, 1984 (no month).

UltraX data sheet, Verseidag Industietextilien Gmbh, 1986 (no month).

S. Raz, "Eine Auswahl optimaler Geotetilien", *Tettinformationen Kettenwir–Praxis*, (2), 35–39 (1990) (no month).

S. Adanur, Ed., "Wellington Sears Handbook of Industrial Textiles", Technomic Publishing Co., Inc., Lancaster, PA 246–247 (1995) (no month).

*Primary Examiner*—Terrel Morris
*Assistant Examiner*—Andrew T Piziali
(74) *Attorney, Agent, or Firm*—Virginia Szigeti

(57) ABSTRACT

Bi-directional and multi-axial fabrics, fabric composites, ballistically resistant assemblies thereof, and the methods by which they are made. The fabrics are comprised of sets of strong, substantially parallel, unidirectional yarns lying in parallel planes, one above the other, with the direction of the yarns in a given plane rotated at an angle to the direction of the yarns in adjacent planes; and one or more sets of yarns having lower strength and higher elongation interleaved with the strong yarns. The fabrics of the invention provide superior ballistic effectiveness compared to ordinary woven and knitted fabrics but retain the ease of manufacture on conventional looms and knitting machines.

29 Claims, 3 Drawing Sheets

U.S. PATENT DOCUMENTS 4,623,574 A 11/1986 Harpell et al. ..... 428/113
4,650,710 A 3/1987 Harpell et al. ..... 428/263
4,681,792 A 7/1987 Harpell et al. ..... 428/102
4,737,401 A 4/1988 Harpell et al. ..... 428/252
4,737,402 A 4/1988 Harpell et al. ..... 428/252
4,738,893 A 4/1988 Grillo ..... 428/252
4,748,064 A 5/1988 Harpell et al. ..... 428/113
4,820,568 A 4/1989 Harpell et al. ..... 428/113
4,883,700 A 11/1989 Harpell et al. ..... 428/113
4,916,000 A 4/1990 Li et al. ..... 428/105
4,953,234 A 9/1990 Li et al. ..... 2/412
5,006,390 A 4/1991 Kavesh et al. ..... 428/105
5,061,545 A 10/1991 Li et al. ..... 428/195
5,112,667 A 5/1992 Li et al. ..... 428/113
5,124,195 A 6/1992 Harpell et al. ..... 428/152
5,165,989 A 11/1992 Bhatnagar et al. ..... 428/245
5,167,876 A 12/1992 Lem et al. ..... 252/602
5,175,040 A 12/1992 Harpell et al. ..... 428/113
5,185,195 A 2/1993 Harpell et al. ..... 428/102
5,187,023 A 2/1993 Prevorsek et al. ..... 442/228
5,190,802 A 3/1993 Pilato ..... 428/111
5,196,252 A 3/1993 Harpell ..... 428/102
5,330,820 A 7/1994 Li et al. ..... 428/113
5,465,760 A 11/1995 Mohamed et al. ..... 139/11
5,471,906 A 12/1995 Bachner, Jr. et al. ..... 89/36.05
5,552,208 A 9/1996 Lin et al. ..... 428/113
5,587,230 A 12/1996 Lin et al. ..... 428/245
5,677,029 A 10/1997 Prevorsek et al. ..... 428/113
5,788,907 A 8/1998 Brown, Jr. et al. ..... 264/280
5,789,327 A 8/1998 Rousseau ..... 442/135
5,958,804 A 9/1999 Brown, Jr. et al. ..... 442/192
6,103,641 A 8/2000 Gehring, Jr. ..... 442/46
6,129,122 A 10/2000 Bilisik ..... 139/11
6,219,842 B1 4/2001 Bachner, Jr. ..... 2/2.5
6,248,676 B1 6/2001 Dischler ..... 442/101
6,268,301 B1 7/2001 Dalman et al. ..... 442/217
6,668,868 B2 * 12/2003 Howland et al. ..... 139/383 R
2001/0053645 A1 12/2001 Henderson ..... 442/135

* cited by examiner

BI-DIRECTIONAL AND MULTI-AXIAL FABRICS AND FABRIC COMPOSITES

CROSS-REFERENCES TO RELATED APPLICATIONS

This application claims the benefit of provisional application Ser. No. 60/387,201 entitled "Bi-Directional Fabric and Fabric Composites" filed Jun. 7, 2002, and is related to U.S. Pat. No. 6,642,159 filed Aug. 16, 2000, entitled "Impact Resistant Rigid Composite and Method of Manufacture" and co-pending application Ser. No. 10/126,202 filed Apr. 19, 2002, entitled, "Ballistic Fabric Laminates".

BACKGROUND OF THE INVENTION

1. Field of the Invention

This invention relates to bi-directional and multi-axial fabrics, fabric composites, ballistically resistant assemblies thereof, and the methods by which they are made.

2. Description of the Related Art

Ballistically resistant fabric-based composites have typically been formed from layers of fabrics that are plied together. The fibers in a fabric can be woven, knitted and/or non-woven. Where the individual fabric plies include non-woven and unidirectionally oriented fibers, successive plies are usually rotated relative to one another, for example at angles of 0°/90° or 0°/45°/90°/45°. The individual fabric plies are generally either uncoated or else embedded in a polymeric matrix material which fills the void spaces between the fibers. If no matrix is present, the fabric or fiber sheet is inherently flexible. A contrasting type of construction is a composite consisting of fibers and a single major matrix material. To construct rigid composites of this type, individual plies are bonded together using heat and pressure to adhere the matrix in each ply, forming a bond between them, and consolidating the whole into a unitary article.

These earlier constructions have several disadvantages. Woven or knitted fabrics generally have poorer ballistic resistance than cross-plied unidirectional fiber composites. On the other hand, woven or knitted fabrics can be produced at lower cost and greater ease of manufacture with more commonly available equipment than can cross-plied unidirectional fiber composites.

A need therefore exists for a fabric construction that retains the advantages of lower cost and greater ease of manufacture, but that has ballistic resistance superior to conventional fabrics. Ideally, the fabric construction would be highly flexible and capable of being bonded to itself or to hard facings to form rigid panels.

U.S. Pat. No. 4,737,401 discloses ballistic resistant fine weave fabric articles. U.S. Pat. Nos. 5,788,907 and 5,958,804 disclose ballistically resistant calendered fabrics. U.S. Pat. No. 4,623,574 discloses simple composites comprising high strength fibers embedded in an elastomeric matrix. U.S. Pat. No. 5,677,029 discloses a flexible penetration resistant composite comprising at least one fibrous layer comprised of a network of strong fibers, and at least one continuous polymeric layer coextensive with, and at least partially bound to a surface of one of the fibrous layers. Aramid fabrics rubber coated on one or both sides are commercially produced by Verseidag Industrietextilien Gmbh. under the product name UltraX. Rigid panels formed by bonding the rubber-coated fabrics together under heat and pressure are also available.

In another context, U.S. Pat. No. 2,893,442 discloses a bi-directional woven fabric having transverse sets of straight and parallel high strength, high modulus yarns interleaved with thin binder yarns. A bi-directional knitted fabric having transverse sets of straight and parallel high strength, high modulus yarns interleaved with thin binder yarns is disclosed in a publication by S. Raz, "Eine Auswahl optimaler Geotextilien," *Tettilinfomationen Kettenwir-Praxis*, (2), 35–39 (1990). A multi-axial warp knit fabric is disclosed in "Wellington Sears Handbook of Industrial Textiles", S. Adanur, Ed., Technomic Publishing Co., Inc., Lancaster, Pa., 246–247 (1995).

Each of the constructions cited above represented progress toward the goals to which they were directed. However, none described the specific constructions of the fabrics, fabric composites and assemblies of this invention, and none satisfied all of the needs met by this invention.

SUMMARY OF THE INVENTION

This invention relates to novel fabrics and fabric composites, assemblies thereof having superior ballistic resistance to penetration by ballistic projectiles, and the method by which they are made. The bi-directional and multi-axial articles of the invention provide superior ballistic effectiveness compared to ordinary woven and knitted fabrics but retain the ease of manufacture on conventional looms and knitting machines.

In a first embodiment, an article of the invention comprises a bi-directional woven fabric comprised of a first set of continuous filament unidirectional yarns lying in a first plane; a second set of continuous filament unidirectional yarns lying in a second plane above said first plane and arranged transversely to said first set of yarns; a third set of yarns arranged transversely to said first set of yarns and interlaced with said first set of yarns, each yarn of the third set lying above some and below the remaining yarns of said first set; a fourth set of yarns arranged transversely to said second set and said third set of yarns and interlaced with said second and thirds sets of yarns, each yarn of the fourth set lying above some and below the remaining yarns of said second and third sets of yarns; wherein each of the yarns comprising said first and second sets of yarns have tenacity's equal to or greater than about 15 g/d, initial tensile moduli equal to or greater than about 400 g/d and energies-to-break equal to or greater than about 22 J/g as measured by ASTM D2256; and wherein each of the yarns comprising said first and second sets of yarns, in proportion to the yarns comprising each of said third and fourth sets of yarns, have at least about twice the breaking strength and at most about one-half the percent elongation to break.

In a second embodiment, an article of the invention comprises a bi-directional knitted fabric comprised of a first set of continuous filament unidirectional yarns lying in a first plane; a second set of continuous filament unidirectional yarns lying in a second plane above said first plane and arranged transversely to said first set of yarns; a third set of interlacing yarns forming interlocking loops interlaced with said first set and said second set of yarns, each yarn of the third set lying above some and below the remaining yarns of said first set and said second set of yarns; wherein each of the yarns comprising said first and second sets of yarns have tenacity's equal to or greater than about 15 g/d, initial tensile moduli equal to or greater than about 400 g/d and energies-to-break equal to or greater than about 22 J/g as measured by ASTM D2256; and wherein each of the yarns comprising said first and second sets of yarns, in proportion to the yarns comprising said third set of yarns has at least about twice the breaking strength and, at most, about one-half the percent elongation to break.

In a third embodiment, an article of the invention is a multi-axial knitted fabric comprised of: a set of continuous filament unidirectional yarns in a bottom plane; a plurality of intermediate planes above said bottom plane each defined by a set of continuous filament unidirectional yarns; a set of continuous filament unidirectional yarns in a top plane; a set of interlacing yarns forming interlocking loops, said loops binding the sets of unidirectional yarns in all planes; wherein the set of unidirectional yarns in each said plane is rotated at an angle relative to the set of unidirectional yarns in adjacent planes; wherein the yarns of each said set of unidirectional yarns have tenacity's equal to or greater than about 15 g/d, initial tensile moduli equal to or greater than about 400 g/d and energies-to-break equal to or greater than about 22 J/g, all as measured by ASTM D2256; and wherein the yarns of each said set of unidirectional yarns, in proportion to said interlacing yarns have at least about twice the breaking strength and, at most, about one-half the percent elongation to break.

In another embodiment, a fabric composite of the invention comprises a fabric embedded in a matrix. The fabric is selected from the group consisting of the woven and the knitted fabrics described, respectively, in the first, second and third embodiments above. The matrix is selected from the group consisting of an elastomeric matrix having an initial tensile modulus less than about 6,000 psi (41.3 MPa), and a rigid matrix having an initial tensile modulus at least about 300,000 psi (2068 MPa)), as measured by ASTM D638.

In another embodiment, a fabric composite of the invention comprises a fabric selected from the group consisting of the woven and the knitted fabrics described, respectively, in the first, second and third embodiments above, embedded in a rigid matrix having an initial tensile modulus at least about 300,000 psi (2068 MPa)) and coated on at least a portion of one surface with an elastomeric material matrix having an initial tensile modulus less than about 6,000 psi (41.3 MPa), both as measured by ASTM D638.

In yet another embodiment, a fabric composite of the invention comprises: a fabric, as described above, embedded in a matrix and a plastic film bonded to at least a portion of one surface of said embedded fabric.

In another embodiment, a fabric composite of the invention comprises a fabric, as described above, with a plastic film bonded to at least a portion of at least one surface of said fabric.

In other embodiments, ballistically resistant articles of the invention are comprised of a plurality of sheets plied together, wherein at least a majority of said sheets are selected from the group consisting of the inventive fabrics and the inventive fabric composites described above.

DETAILED DESCRIPTION OF THE INVENTION

This invention relates to novel fabrics and fabric composites, assemblies thereof having superior ballistic resistance to penetration by ballistic projectiles, and to the methods by which they are made.

In one embodiment, an article of the invention comprises a bi-directional woven fabric comprised of a first set of continuous filament unidirectional yarns lying in a first plane; a second set of continuous filament unidirectional yarns lying in a second plane above said first plane and arranged transversely to said first set of yarns; a third set of yarns arranged transversely to said first set of yarns and interlaced with said first set of yarns, each yarn of the third set lying above some and below the remaining yarns of said first set; a fourth set of yarns arranged transversely to said second set and said third set of yarns and interlaced with said second and third sets of yarns, each yarn of the fourth set lying above some and below the remaining yarns of said second and third sets of yarns; wherein each of the yarns comprising said first and second sets of yarns have tenacity's equal to or greater than about 15 g/d, initial tensile moduli equal to or greater than about 400 g/d and energies-to-break equal to or greater than about 22 J/g as measured by ASTM D2256; and wherein each of the yarns comprising said first and second sets of yarns, in proportion to the yarns comprising each of said third and fourth sets of yarns, have at least about twice the breaking strength and at most about one-half the percent elongation to break.

Figure 1:
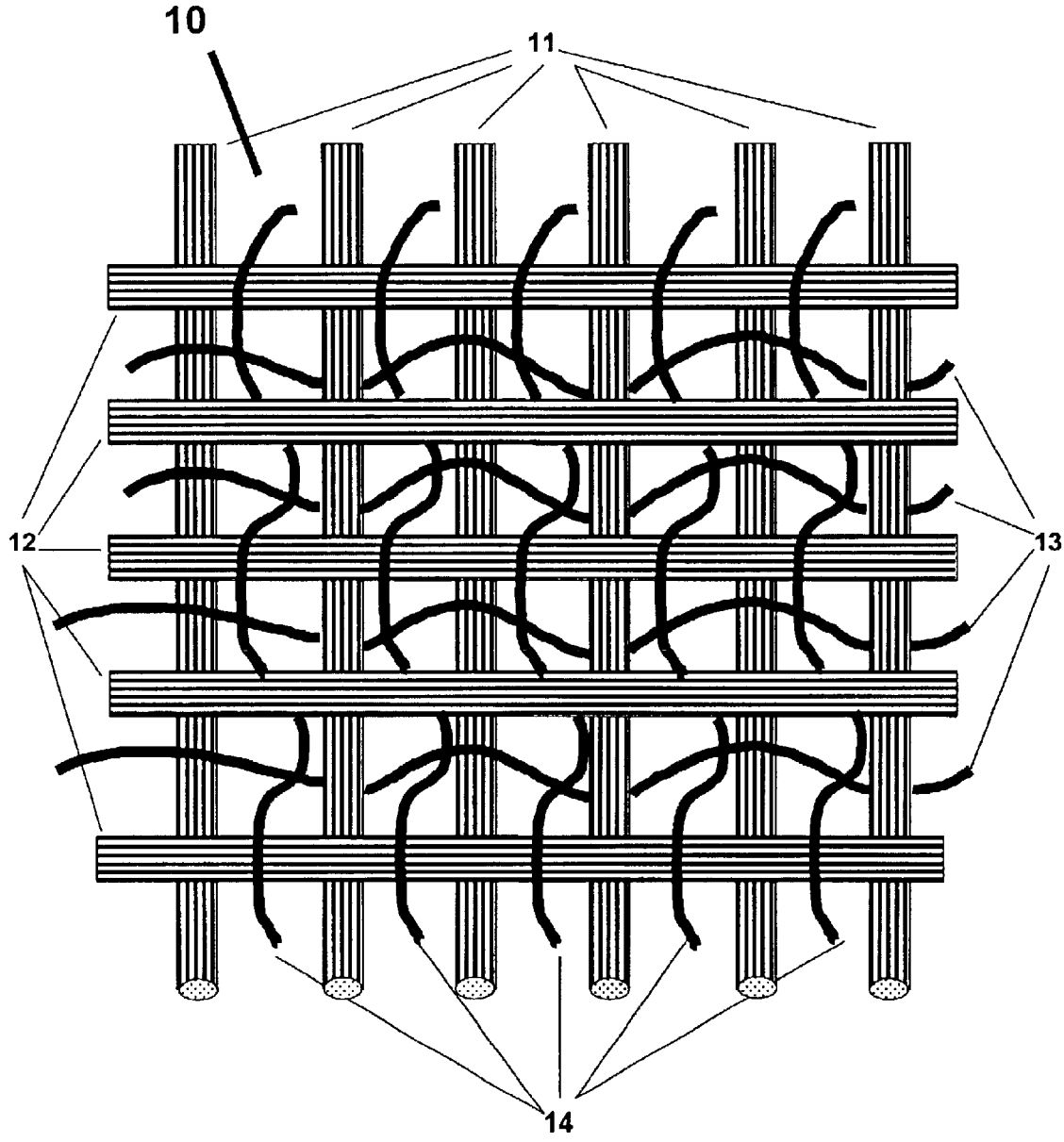
FIG. 1 is a schematic representation of a woven fabric of the invention.

FIG. 1 is a schematic representation of a bi-directional woven fabric 10 of the invention. A first set of continuous filament unidirectional yarns 11 lies in a first plane. A second set of continuous filament unidirectional yarns 12 lies in a second plane above the first plane and arranged transversely to the first set of yarns 11. A third set of yarns 13 is arranged transversely to the first set of yarns 11 and is interlaced with the first set of yarns 11. A fourth set of yarns 14 is arranged transversely to the second set and the third set of yarns (12 and 13, respectively) and is interlaced with the second and thirds sets of yarns, 12 and 13, respectively.

In a second embodiment, an article of the invention comprises a bi-directional knitted fabric comprised of a first set of continuous filament unidirectional yarns lying in a first plane; a second set of continuous filament unidirectional yarns lying in a second plane above said first plane and arranged transversely to said first set of yarns; a third set of interlacing yarns forming interlocking loops interlaced with said first and said second set of yarns, each yarn of the third set lying above some and below the remaining yarns of said first set and said second set of yarns; wherein each of the yarns comprising said first and second sets of yarns have tenacity's equal to or greater than about 15 g/d, initial tensile moduli equal to or greater than about 400 g/d and energies-to-break equal to or greater than about 22 J/g as measured by ASTM D2256; and wherein each of the yarns comprising said first and second sets of yarns, in proportion to the yarns comprising said third set of yarns have at least about twice the breaking strength and at most about one-half the percent elongation to break.

Figure 2:
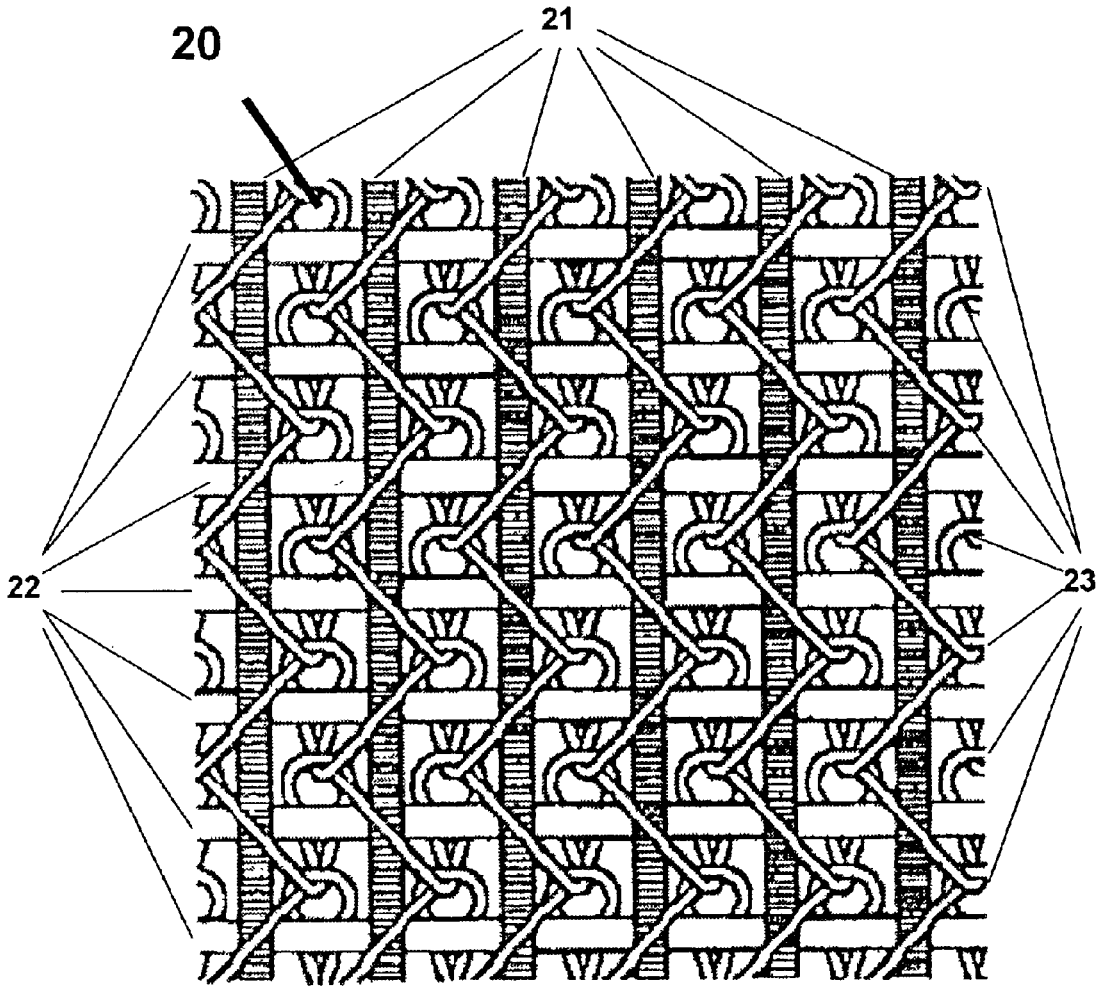
FIG. 2 is a schematic representation of a knitted fabric of the invention.

FIG. 2 is a schematic representation of a bi-directional knitted fabric 20 of the invention. A first set of continuous filament unidirectional yarns 21 lies in a first plane. A second set of continuous filament unidirectional yarns 22 lies in a second plane above the first plane arranged transversely to the first set of yarns 21. A third set of yarns 23 is interlaced with the first and second sets of yarns, 21 and 22 respectively, in interlocking loops. FIG. 2 shows a tricot knit but other knit configurations that stabilize the first and second sets of yarn, 21 and 22, are suitable such as interlocking weft chain stitches.

In a third embodiment, an article of the invention is a multi-axial knitted fabric comprised of: a set of continuous filament unidirectional yarns in a bottom plane; a plurality of intermediate planes above said bottom plane each defined by a set of continuous filament unidirectional yarns; a set of continuous filament unidirectional yarns in a top plane; a set of interlacing yarns forming interlocking loops, said loops binding the sets of unidirectional yarns in all planes; wherein the set of unidirectional yarns in each said plane is rotated at an angle relative to the set of unidirectional yarns in adjacent planes; wherein the yarns of each said set of unidirectional yarns have tenacity's equal to or greater than about 15 g/d, initial tensile moduli equal to or greater than about 400 g/d and energies-to-break equal to or greater than about 22 J/g, all as measured by ASTM D2256; and wherein the yarns of each said set of unidirectional yarns, in proportion to said interlacing yarns have at least about twice the breaking strength and, at most, about one-half the percent elongation to break.

Figure 3:
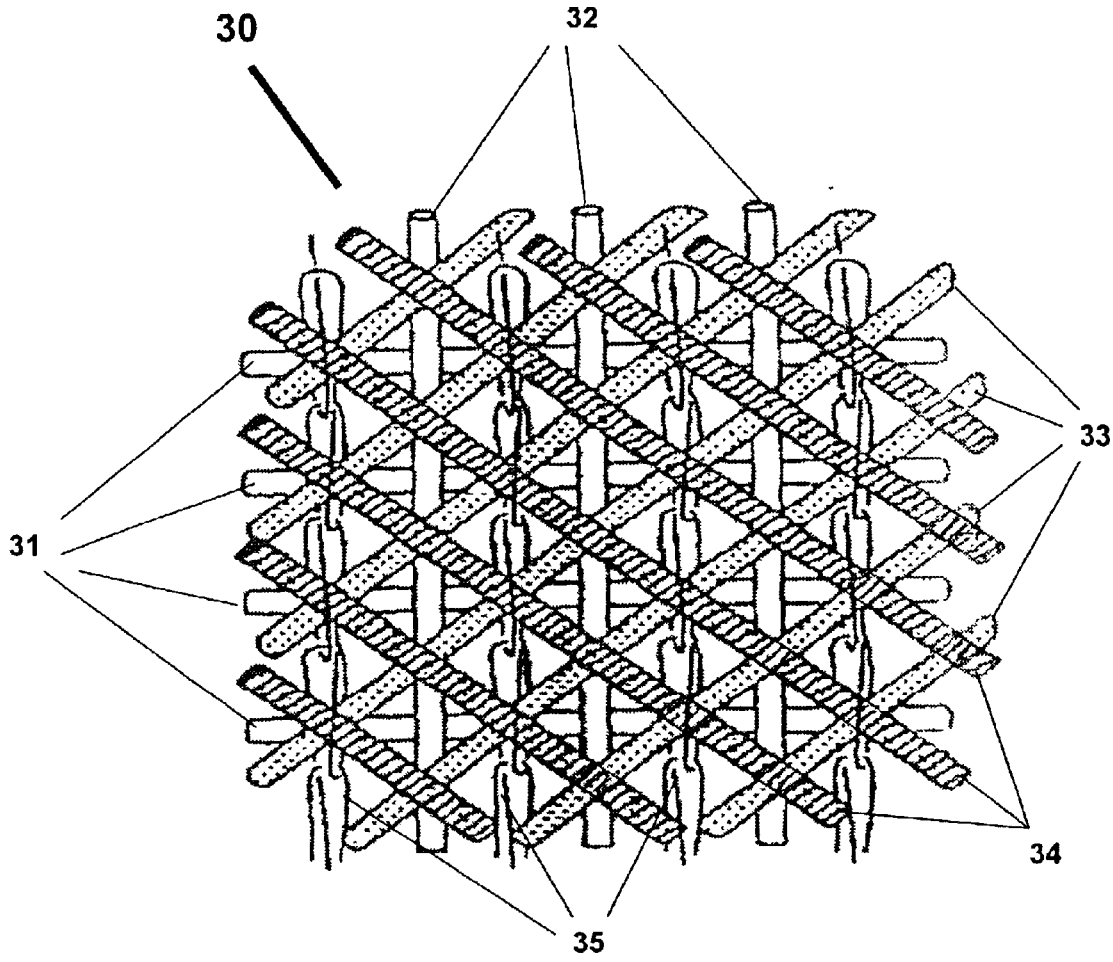
FIG. 3 is a schematic representation of a multi-axial knitted fabric of the invention.

FIG. 3 is a schematic representation of a multi-axial knitted fabric 30 of the invention. A first set of continuous filament unidirectional yarns 31 defines a bottom plane of the fabric. In the embodiment illustrated, two intermediate planes above the bottom plane are defined by sets of continuous filament unidirectional yarns 32 and 33. A continuous filament unidirectional yarn set 34 defines a top plane of the fabric. A set of interlacing yarns 35 form interlocking loops that enclose the unidirectional yarns in all planes.

The directions of the unidirectional yarns in each plane of the fabric are rotated at an angle to the unidirectional yarns in adjacent planes. In the specific embodiment illustrated, the yarn set 32 in the first intermediate plane is rotated at an angle of 90° to the yarns 31 in the bottom plane. The yarns 33 in the second intermediate plane are rotated at an angle of 45° to the yarns 32 in the first intermediate plane. The yarns 34 in the top plane are rotated at an angle of 90° to the yarns 33 in the second intermediate plane.

It will be evident that the multi-axial fabric of the invention may be comprised of greater numbers of intermediate planes and/or different angles of rotation between yarn planes than is illustrated in FIG. 3. Preferably, the number of yarn planes and the angles between the unidirectional yarns are chosen to provide symmetrical properties to the fabric.

For the purposes of the present invention, a fiber is an elongate body the length dimension of which is much greater than the transverse dimensions of width and thickness. Accordingly, the term fiber includes filament, ribbon, strip, and the like having regular or irregular cross-section. A yarn is a continuous strand comprised of many fibers or filaments. The fibers comprising the yarn may be continuous through the length of the yarn or the fibers may be staple fibers of lengths much shorter than the yarn.

The continuous filament unidirectional yarns are the primary structural components of the bi-directional and multi-axial fabrics of the invention. The interlacing yarns provide integrity to the fabrics without deforming the unidirectional sets of yarns from an essentially planar configuration.

The continuous filament unidirectional yarns may be comprised of the same or different fiber materials, fiber forms, tensile properties and deniers. Preferably, the continuous filament unidirectional sets of yarns are each selected independently from the group consisting of continuous filament highly oriented, high molecular weight polyolefins, aramids, polybenzazoles and blends thereof. Most preferably, the continuous filament unidirectional sets of yarns are each selected independently from the group consisting of continuous filament highly oriented, high molecular weight polyethylene, poly(p-phenylene terephthalamide, poly(m-phenylene isophthalamide), poly (benzobisoxazole, poly(benzobisthiazole), poly (benzobisimidazole) and blends thereof.

U.S. Pat. No. 4,457,985 generally discusses high molecular weight polyethylene and polypropylene fibers. In the case of polyethylene, suitable fibers are those of weight average molecular weight of at least 150,000, preferably at least one million and more preferably between two million and five million. Such high molecular weight polyethylene fibers may be grown in solution as described in U.S. Pat. No. 4,137,394 or U.S. Pat. No. 4,356,138, or may be filament spun from a solution to form a gel structure, as described in U.S. Pat. No. 4,413,110, or may be produced by a rolling and drawing process as described in U.S. Pat. No. 5,702,657.

As used herein, the term polyethylene means a predominantly linear polyethylene material that may contain minor amounts of chain branching or comonomers not exceeding 5 modifying units per 100 main chain carbon atoms, and that may also contain admixed therewith not more than about 50 wt % of one or more polymeric additives such as alkene-I-polymers, in particular low density polyethylene, polypropylene or polybutylene, copolymers containing monoolefins as primary monomers, oxidized polyolefins, graft polyolefin copolymers and polyoxymethylenes, or low molecular weight additives such as anti-oxidants, lubricants, ultra-violet screening agents, colorants and the like.

Depending upon the formation technique, the draw ratio and temperatures, and other conditions, a variety of properties can be imparted to these fibers. The tenacity of the fibers should be at least 15 g/denier, preferably at least 20 g/denier, more preferably at least 25 g/denier and most preferably at least 30 g/denier. Similarly, the initial tensile modulus of the fibers, as measured by an Instron tensile testing machine, is at least 300 g/denier, preferably at least 500 g/denier and more preferably at least 1,000 g/denier and most preferably at least 1,200 g/denier.

These highest values for initial tensile modulus and tenacity are generally obtainable only by employing solution grown or gel spinning processes. Many of the filaments have melting points higher than the melting point of the polymer from which they were formed. Thus, for example, polyethylene of weight average molecular weights from about 150,000 to two million generally have melting points in the bulk of about 138° C. The highly oriented polyethylene filaments made of these materials have melting points of from about 7 to about 13° C. higher. Thus, a slight increase in melting point reflects the crystalline perfection and higher crystalline orientation of the filaments as compared to the bulk polymer.

In the case of aramid fibers, suitable fibers formed from aromatic polyamides are described in U.S. Pat. No. 3,671,542. Preferred aramid fibers will have a tenacity of at least about 20 g/d, an initial tensile modulus of at least about 400 g/d and an energy-to-break at least about 8 J/g, and particularly preferred aramid fibers will have a tenacity of at least about 20 g/d, and an energy-to-break of at least about 20 J/g. Most preferred aramid fibers will have a tenacity of at least about 20 g/denier, a modulus of at least about 900 g/denier and an energy-to-break of at least about 30 J/g. For example, poly(p-phenylene terephalamide) filaments produced commercially by DuPont Corporation under the KEVLAR® trademark are particularly useful in forming ballistic resistant composites. KEVLAR 29 has 500 g/denier and 22 g/denier and KEVLAR 49 has 1000 g/denier and 22 g/denier as values of initial tensile modulus and tenacity, respectively. Also useful in the practice of this invention is poly(m-phenylene isophthalamide) fibers produced commercially by DuPont under the NOMEX® trademark.

Suitable polybenzazole fibers for the practice of this invention are disclosed for example in U.S. Pat. Nos. 5,286,833, 5,296,185, 5,356,584, 5,534,205 and 6,040,050. Preferably, the polybenzazole fibers are selected from the group consisting of poly(benzobisoxazole, poly (benzobisthiazole), and poly(benzobisimidazole). Most preferably, the polybenzazole fibers are ZYLON® poly(p-phenylene-2,6-benzobisoxazole) fibers from Toyobo Co.

The deniers of the continuous filament unidirectional sets of yarns are independently selected in the range of from about 100 to about 3000, more preferably in the range of from about 750 to about 1500.

The spacing of the yarns within each set of unidirectional yarns may be the same or different from that of yarns within other unidirectional yarn sets. By "spacing" is meant the distance between parallel yarn ends within the set. The spacing between yarns will be greater for heavier denier yarns and smaller for lower denier yarns. Preferably the yarn spacing for each of the unidirectional sets of yarns is independently selected in the range of from about 5 ends/in (2 ends/cm) to about 50 ends/in (20 ends/cm), more preferably in the range of from about 8 ends/in (3.2 ends/cm) to about 20 ends/in (7.9 ends/cm). A yarn spacing of about 8 ends/in (3.2 ends/cm) to about 12 ends/in (4.7 ends/cm) is preferred for 1200 denier SPECTRA® highly oriented high molecular weight polyethylene yarns from Honeywell International Inc.

In the bi-directional woven fabrics of the invention, the spacing of the yarns in the third set is generally an integral multiple of the yarn spacing within the set having yarns parallel thereto, i.e., the first set in FIG. 1. The spacing of the yarns in the fourth set is also generally an integral multiple of the yarn spacing within the set having yarns parallel thereto, i.e., the second set of yarns in FIG. 1. For example, if the space between yarn ends in the first set is 0.1 inches, the space between yarn ends in the third set may be 0.1, 0.2, 0.3, 0.4 . . . inches. Preferably, the yarn spacing of the third and fourth sets is the same as that of the yarn set to which they are parallel.

The following comments are directed to the sets of interlacing yarns in a fabric of the invention, i.e., the third and fourth yarn sets in a woven bi-directional fabric of the invention, the third yarn set in a knitted bi-directional fabric of the invention, and the interlacing and loop-forming yarn set in a knitted multi-axial fabric of the invention.

The sets of interlacing yarns, where more than one, may be formed of different fiber materials and fiber forms. Preferably, the interlacing sets of yarns are each selected independently from the group consisting of polyamides, polyesters, polyvinyl alcohol, polyolefins, polyacrylonitrile, polyurethane, cellulose acetate, cotton, wool, and copolymers and blends thereof. Most preferably, the interlacing sets of yarns are selected from the group consisting of nylon 6, nylon 66, polyethylene terephthalate (PET), polyethylene naphthalate, (PEN), polybutylene terephthalate (PBT), polytrimethylene terephthalate (PTT), polypropylene, polyvinyl alcohol and polyurethane. The interlacing sets of yarns may be comprised of elastomeric fibers or staple fibers.

The yarns in the interlacing yarn sets are selected so as not to possess more than about one-half the breaking strength (load at break, lbs (Kg)) and have no less than about twice the percent elongation to break of each of the unidirectional yarns. Preferably, the breaking strengths of each of the interlacing sets of yarns do not exceed about one-third of the breaking strength and have no less than about six times the percent elongation at break of each of the unidirectional sets of yarns. Most preferably, the breaking strengths of each of the interlacing sets of yarns do not exceed about one-third of the breaking strength and have no less than ten times the percent elongation of each of the unidirectional sets of yarns. These choices insure that the unidirectional yarns will remain essentially unrestrained during a ballistic impact and will be best able to participate in absorbing the energy of a projectile.

Yarns comprised of staple fibers generally have lower tenacity's than continuous filament yarns and may be used at higher deniers than continuous filament yarns in the interlacing sets of yarns.

The fibers in all sets of yarns may be twisted or entangled as disclosed in U.S. Pat. No. 5,773,370. Preferably, the unidirectional sets of yarns in each embodiment have minimum twist, from about zero turns/in to about 2 turns/in (0.78 turns/cm). Ballistics are typically better with a zero twist structural yarn. Greater twist levels are preferred for the yarns in interlacing yarn sets, from about 2 turns/in (0.28 turns/cm) to about 10 turns/in (3.9 turns/cm).

Preferably, the woven and knitted fabrics of the invention are calendered. Preferably, the calendering is conducted by passing the fabric through opposed rolls rotating at the same speed and applying a pressure of about 800 lbs/inch (140 kN/m) to about 1200 lbs/inch (210 kN/m) of fabric width at a temperature ranging from about 100° C. to about 130° C. Preferably the calendering pressure is about 900 lbs/inch (158 kN/m) to about 1000 lbs/inch (175 kN/m) of fabric width, and the temperature ranges from about 115° C. to about 125° C.

In another embodiment, a fabric composite of the invention comprises a fabric, selected from the group consisting of the inventive woven and knitted fabrics described above, embedded in a matrix selected from the group consisting of an elastomeric material having an initial tensile modulus less than about 6,000 psi (41.3 MPa), and a rigid resin having an initial tensile modulus at least about 300,000 psi (2068 MPa), as measured by ASTM D638.

The matrix preferably comprises about 5 to about 30, more preferably about 10 to about 20, percent by weight of the fabric composite. The matrix material is preferably applied by applying an uncured liquid matrix or a solution of the matrix material onto the fabric by means of a wetted roll and doctoring the liquid into the fabric to accomplish complete impregnation. Alternatively, dipping or immersion of the fabric into a liquid bath may be employed.

A wide variety of elastomeric materials and formulations having appropriately low modulus may be utilized as the matrix. For example, any of the following materials may be employed: polybutadiene polyisoprene, natural rubber, ethylene-propylene copolymers, ethylene-propylene-diene terpolymers, polysulfide polymers, polyurethane elastomers, cholorosulfinated polyethylene, polychloroprene, plasticized polyvinylchloride using dioctyl phthalate or other plasticizers well known in the art, butadiene acrylonitrile elastomers, poly (isobutylene-co-isoprene), polyacrylates, polyesters, polyethers, fluoroelastomers, silicone elastomers, thermoplastic elastomers, copolymers of ethylene.

Preferably, the elastomeric material does not bond too well or too loosely to the fabric material. Preferred for polyethylene fabrics are block copolymers of conjugated dienes and vinyl aromatic copolymers. Butadiene and isoprene are preferred conjugated diene elastomers. Styrene, vinyl toluene and t-butyl styrene are preferred conjugated aromatic monomers. Block copolymers incorporating polyisoprene may be hydrogenated to produce thermoplastic elastomers having saturated hydrocarbon elastomer segments. The polymers may be simple tri-block copolymers of the type R-$(BA)_x$(x=3–150); wherein A is a block from a polyvinyl aromatic monomer and B is a block from a conjugated diene elastomer. Many of these polymers are produced commercially by Kraton Polymers, Inc.

The low modulus elastomer may be compounded with fillers such as carbon black, silica, etc., and may be extended with oils and vulcanized by sulfur, peroxide, metal oxide or radiation cure systems using methods well known to rubber technologists. Blends of different elastomeric materials may be used together or one or more elastomers may be blended with one or more thermoplastics.

A rigid matrix resin useful in a fabric composite of the invention preferably possesses an initial tensile modulus at least 300,000 psi (2068 MPa) as measured by ASTM D638. Preferred matrix resins include at least one thermoset vinyl ester, diallyl phthalate, and optionally a catalyst for curing the vinyl ester resin.

Preferably, the vinyl ester is one produced by the esterification of a polyfunctional epoxy resin with an unsaturated monocarboxylic acid, usually methacrylic or acrylic acid.

Illustrative vinyl esters include diglycidyl adipate, diglycidyl isophthalate, di-(2,3-epoxybutyl)adipate, di-(2,3-epoxybutyl)oxalate, di-(2,3-epoxyhexyl)succinate, di-(3,4-epoxybutyl)maleate, di-(2,3-epoxyoctyl)pimelate, di-(2,3-epoxybutyl)phthalate, di-(2,3-epoxyoctyl) tetrahydrophthalate, di-(4,5-epoxy-dodecyl)maleate, di-(2,3-epoxybutyl)terephthalate, di-(2,3-epoxypentyl) thiodipropronate, di-(5,6-epoxy-tetradecyl) diphenyldicarboxylate, di-(3,4-epoxyheptyl) sulphonyldibutyrate, tri-(2,3-epoxybutyl)-1,2,4-butanetricarboxylate, di-(5,6-epoxypentadecyl)maleate, di-(2,3-epoxybutyl)azelate, di(3,4-epoxypentadecyl)citrate, di-(4,5-epoxyoctyl)cyclohexane-1,3-dicarboxylate, di-(4,5-epoxyoctadecyl)malonate, bisphenol-A-fumaric acid polyester and similar materials. Particularly preferred are the epoxy vinyl esters available from Dow Chemical Company under the DERAKANE® trademark.

In another embodiment, a fabric composite of the invention comprises a fabric selected from the group consisting of the woven and the knitted fabrics described, respectively, in the first, second and third embodiments described above, embedded in a rigid matrix having an initial tensile modulus at least about 300,000 psi (2068 MPa)) and coated on at least a portion of one surface with an elastomeric material having an initial tensile modulus less than about 6,000 psi (41.3 MPa), both as measured by ASTM D638.

In another embodiment, a fabric composite of the invention comprises: a fabric selected from the group consisting of the inventive woven fabric described above and an inventive knitted fabric described above embedded in a matrix selected from the group consisting of an elastomeric material having an initial tensile modulus less than about 6,000 psi (41.3 MPa), and a rigid resin having an initial tensile modulus at least about 300,000 psi (2068 MPa), as measured by ASTM D638; and a plastic film bonded to at least a portion of one surface of said embedded fabric.

In another embodiment, a fabric composite of the invention comprises a fabric selected from the group consisting of the inventive woven fabric described above and an inventive knitted fabric described above; an elastomer coated on at least a portion of at least one surface of the fabric, the elastomer having an initial tensile modulus equal to or less than about 6,000 psi (41.3 MPa) as measured by ASTM D638; and a plastic film bonded to at least a portion of the elastomer-coated surface.

In another embodiment, a fabric composite of the invention comprises a fabric selected from the group consisting of the inventive woven fabric described above and an inventive knitted fabric described above, with a plastic film bonded to at least a portion of at least one of the fabric surfaces.

The plastic film useful in a composite of the invention may be selected from the group consisting of polyolefins, polyamides, polyesters, polyurethanes, vinyl polymers, fluoropolymers and copolymers and mixtures thereof. Preferably, the plastic film does not bond too tightly or too loosely to the fabric or to the matrix material. Where the matrix is a block copolymer of a conjugated diene and a vinyl aromatic copolymer, the plastic film is preferably linear low density polyethylene. Similarly, where the matrix resin is a vinyl ester resin, the plastic film is preferably linear low density polyethylene.

The plastic film is preferably from 0.0002 inches (5.1 micrometers) to about 0.005 inches (127 micrometers), more preferably, from about 0.0003 inches (7.6 micrometers) to about 0.003 inches (76 micrometers), in thickness.

The plastic film preferably comprises from about 0.5 to about 5 percent by weight of the fabric composite. Preferably the plastic film is biaxially oriented. Preferably the plastic film is bonded to the fabric or the fabric composite by means of heat and pressure.

In other embodiments, ballistically resistant articles of the invention are comprised of a plurality of sheets plied together, wherein at least a majority of said sheets are selected from the group consisting of the inventive fabrics and the inventive fabric composites described above.

Complete analysis of penetration of fiber composites is still beyond present capabilities, although several mechanisms have been identified. A small pointed projectile can penetrate armor by laterally displacing fibers without breaking them. In this case, the penetration resistance depends on how readily fibers may be pushed aside, and therefore, on the nature of the fiber network. Important factors are the tightness of weave or periodicity of cross-overs in cross-plied unidirectional composites, yarn and fiber denier, fiber-to-fiber friction, matrix characteristics, interlaminar bond strengths and others. Sharp fragments can penetrate by shearing fibers.

Projectiles may also break fibers in tension. Impact of a projectile on a fabric causes propagation of a strain wave through the fabric. Ballistic resistance is greater if the strain wave can propagate rapidly and unimpeded through the fabric and involve greater volumes of fiber. Experimental and analytical work has shown that in all actual cases, all penetration modes exist and that their relative importance is greatly affected by the design of the composite.

In one embodiment, a ballistically resistant article of the invention is comprised of a plurality of fabric sheets plied together in stacked array, wherein at least a majority of the fabric sheets are selected from the group consisting of a calendered woven fabric having the characteristics described above and a calendered knitted fabric having the characteristics described above.

In other embodiments, a ballistically resistant article of the invention is comprised of a plurality of fabric composite sheets plied together in stacked array, wherein at least a majority of the fabric composite sheets have the characteristics of any one of the inventive fabric composites previously described.

In yet other embodiments, the invention consists of methods for the production of the ballistically resistant articles of the invention.

One method of the invention comprises the steps of producing, by weaving or knitting, a bi-directional or multi-directional fabric having the characteristics described above, and plying sheets of the fabric in stacked array. Preferably, the fabric of the invention is calendered. Preferably, the fabric sheets are joined together by joining means such as stitching.

In another embodiment, the method of the invention comprises the steps of: producing, by weaving or knitting, a bi-directional or multi-axial fabric having the characteristics described above; calendering the fabric; embedding the fabric in a matrix material selected from the group consisting of an elastomer having an initial tensile modulus less than about 6,000 psi (41.3 MPa) and a rigid resin having an initial tensile modulus at least about 300,000 psi (2068 MPa), as measured by ASTM D638, to produce a fabric composite; plying sheets of the fabric composite in stacked array; and bonding and curing the sheets of said fabric composite together to form a unitary article Preferably, a plastic sheet is bonded to at least a portion of one surface of the fabric composite prior to plying the sheets of the fabric composite in stacked array.

In another embodiment, the method of the invention comprises the steps of: producing, by weaving or knitting, a bi-directional or multi-axial fabric having the characteristics described above; calendering the fabric; bonding a plastic film to at least a portion of at least one of the fabric surfaces to produce a fabric composite; plying sheets of the fabric composite in stacked array; and bonding the sheets of the fabric composite together to form a unitary article.

In another embodiment, the method of the invention comprises the steps of: producing, by weaving or knitting, a bi-directional or multi-axial fabric having the characteristics described above; calendering the fabric; embedding the fabric in a matrix consisting essentially of a rigid resin having an initial tensile modulus at least about 300,000 psi (2068 MPa), as measured by ASTM D638, to produce a fabric composite; applying to the surface of the fabric composite an elastomeric material having a tensile modulus less than about 6000 psi (41.3 MPa), as measured by ASTM D638, to produce an elastomeric-coated fabric composite; plying sheets of the elastomeric-coated fabric composite in stacked array; and bonding and curing the sheets of the elastomeric-coated fabric composite together to form a unitary article.

The following examples are presented to provide a more complete understanding of the invention. The specific techniques, conditions, materials, proportions and reported data set forth to illustrate the principles of the invention are exemplary and should not be construed as limiting the scope of the invention.

EXAMPLES

Comparative Example 1

A highly oriented, high molecular weight polyethylene yarn (SPECTRA® 900 from Honeywell International Inc.) was woven into a plain weave fabric of 21×21 ends/in (8.3 ends/cm) on an American Iwer Model A2 180 loom. The polyethylene yarn was of 1200 denier and had a tenacity of 30 g/d, initial tensile modulus of 850 g/d, energy-to-break of 40 J/g, breaking strength of 36 Kg and 3.6% elongation at break. The fabric was impregnated with an epoxy vinyl ester resin [DERAKANE® 411-45 from Dow Chemical containing 1% LUPEROX® 256 curing agent (2,5-dimethyl-2,5 di(2-ethyl (hexanoylperoxy)hexane) from Elf Atochem]. The initial tensile modulus of the neat resin in the cured state was 490,000 psi (3379 MPa). The resin content of the fabric prepreg was 20% by weight.

Seventeen sheets of fabric prepreg having dimensions of 12"×12" (30.5 cm×30.5 cm) were stacked together and were bonded and cured into a unitary fabric composite panel by heating in a press at 116° C. under a pressure of 550 psi (3.8 MPa) for 20 minutes. The areal density of the fabric composite panel was 1.05 lbs/sq. ft. (5.13 Kg/sq.m).

Comparative Example 2

A second set of seventeen 12"×12" (30.5 cm×30.5 cm) sheets of the same fabric prepreg prepared in Comparative Example 1 were cut and stacked together. The sheets were bonded and cured into a unitary fabric composite panel by heating in a press at 116° C. under a pressure of 550 psi (3.8 MPa) for 20 minutes. The areal density of the second fabric composite panel was 1.06 lbs/sq. ft. (5.18 Kg/sq.m).

Comparative Example 3

A highly oriented, high molecular weight polyethylene yarn (SPECTRA® 1000 from Honeywell International Inc.) is woven into a plain weave fabric of 21×21 ends/in (8.3 end/cm) on an American Iwer Model A2 180 loom. The polyethylene yarn is of 1300 denier and has a tenacity of 35 g/d, initial tensile modulus of 1150 g/d, energy-to-break of 45 J/g, breaking strength of 45 Kg and 3.4% elongation at break. The fabric is calendered by passing the fabric through opposed rolls rotating at the same speed and applying a pressure of 952 lbs/inch (163 kN/m) of fabric width at 121° C.

The fabric is impregnated with an epoxy vinyl ester resin, DERAKANE® 411-45 containing 1% LUPEROX® 256 curing agent. The initial tensile modulus of the neat resin in a cured state is 490,000 psi (3379 MPa). The resin content of the fabric prepreg is 20% by weight. Seventeen sheets of fabric prepreg having dimensions of 12"×12" (30.5 cm×30.5 cm) are stacked together and are bonded and cured into a unitary fabric composite panel by heating in a press at 116° C. under a pressure of 550 psi (3.8 MPa) for 20 minutes. The areal density of the fabric composite panel is 1.0 lbs/sq. ft. (4.89 Kg/sq.m).

Example 1

A bi-directional fabric of the invention was woven on an American Iwer Model A2 180 loom. The fabric consisted of four yarn sets. The first yarn and second yarn sets each consisted of parallel highly oriented, high molecular weight continuous filament polyethylene yarns (SPECTRA® 1000 from Honeywell International Inc.) of 1300 denier and having a tenacity of 35 g/d, initial tensile modulus of 1150 g/d, energy-to-break of 45 J/g, breaking strength of 45 Kg and 3.4% elongation at break. Referring to the schematic representation of FIG. 1, the first yarn set 11 and the second yarn set 12 were unidirectionally oriented transverse to one another in separate planes, one above the other. A third yarn set 13 arranged transversely to the first yarn set 11 and interlaced with the yarns of the first set consisted of polyvinyl alcohol yarns of 75 denier and having a breaking strength of 0.38 Kg and 20% elongation at break. A fourth yarn set 14 arranged transversely to the second and third yarn sets and interlaced with the yarns of the second and third yarn sets consisted of the same polyvinyl alcohol yarn. The spacing of each of the four yarn sets in the fabric was 9 ends/in (3.5 ends/cm).

The bi-directional fabric was calendered by passing the fabric through opposed rolls rotating at the same speed and applying a pressure of 952 lbs/inch (163 kN/m) of fabric width at 121° C. The calendered fabric was impregnated with 20% by weight of an epoxy vinyl ester resin having an initial tensile modulus in the cured state of 490,000 psi (3379 MPa) (DERAKANE® 411-45 containing 1% LUPEROX® 256 curing agent). Thirty-four sheets of this prepreg of 12"×12" (30.5 cm×30.5 cm) dimension were bonded and cured into a unitary fabric composite panel by heating in a press at 116° C. under a pressure of 550 psi (3.8 MPa) for 20 minutes. The areal density of the fabric composite panel was 1.01 lbs/sq. ft. (4.94 Kg/sq.m).

Example 2

A second-set of thirty-four 12"×12" (30.5 cm×30.5 cm) sheets of the same bi-directional fabric prepreg prepared in Example 1 were cut and stacked together. The sheets were bonded and cured into a unitary fabric composite panel by heating in a press at 116° C. under a pressure of 550 psi (3.8 MPa) for 20 minutes. The areal density of the second bi-directional fabric composite panel was 1.03 lbs/sq. ft. (5.03 Kg/sq.m).

Example 3

A bi-directional fabric of the invention was knitted on a weft inserted, warp knit machine from Liba, Inc. The fabric consisted of three yarn sets. The first yarn and second yarn sets each consisted of highly oriented high molecular weight continuous filament polyethylene yarns (SPECTRA® 1000 from Honeywell International Inc.) of 1300 denier and having a tenacity of 35 g/d, initial tensile modulus of 1150 g/d, energy-to-break of 45 J/g, breaking strength of 45 Kg and 3.4% elongation at break. Referring to the schematic representation of FIG. 2, the first yarn set 21 and the second yarn set 22 were unidirectionally oriented transverse to one another in separate planes, one above the other. The spacing of yarns in each of the first and second yarn sets in the fabric was 9 ends/in (3.5 ends/cm). A third yarn set 23 consisting of polyvinyl alcohol of 75 denier and having 0.38 Kg breaking strength, 22% elongation at break was interleaved with both the first and second yarn sets with a tricot stitch.

The bi-directional knitted fabric is calendered as in Example 1 and impregnated with 20% by weight of epoxy vinyl ester resin having an initial tensile modulus in the cured state of 490,000 psi (3379 MPa) (DERAKANE 411-45 containing 1% Lubrisol 256 curing agent).

Thirty-four sheets of this prepreg of 12"×12" (30.5 cm×30.5 cm) dimension are bonded and cured into a unitary fabric composite panel by heating in a press at 116° C. under a pressure of 550 psi (3.8 MPa) for 20 minutes. The areal density of the fabric composite panel is 1.0 lbs/sq. ft. (4.9 Kg/sq.m).

Ballistic Testing

The fabric composite panels of Comparative Examples 1 to 3 and Examples 1 to 3 were tested for ballistic resistance by the method of MIL-STD-662E using a 17-grain FSP (fragment simulating projectile) specified by MIL-P-46593A. The velocities at which 50% of projectiles failed to penetrate the target (V50) and the specific energy absorption of the targets (SEAT) were determined. Table I below shows the results of the ballistic testing.

TABLE I

Ballistic Test Results on Fabric Composite Panels

| Ex. No. | Fabric Construction | Areal Density, Kg/sq. m | V50, m/sec | SEAT, J-m2/Kg |
|---|---|---|---|---|
| Comp. 1 | Plain Weave | 5.13 | 465 | 23.2 |
| Comp. 2 | Plain Weave | 5.18 | 471 | 23.6 |
| Comp. 3 | Plain Weave | 4.9 | ≈465 | ≈25.8 |
| 1 | Bi-directional Woven | 4.94 | 497 | 27.6 |
| 2 | Bi-directional Woven | 5.03 | 512 | 28.7 |
| 3 | Bi-directional Knitted | 4.9 | ≈490 | ≈28.6 |

It is seen that the bi-directional fabrics of Examples 1 and 2 of the present invention were superior to plain weave fabrics of Comparative Examples 1 and 2 in providing ballistic resistance to composite panels constructed from these fabrics. Results for the Example 3 bi-directional knitted fabric are anticipated to be similarly superior.

Without being held to a particular theory, it is believed that the planar nature of the strong yarns in the bi-directional fabrics permits the elastic strain wave initiated by the projectile to propagate relatively unimpeded and permits greater lengths of fibers to participate in absorbing the energy of the projectile. In comparison, each interleaving of strong yarns in the plain weave fabric restricts propagation of the ballistic event through the fabric and so concentrates the energy of the projectile in a relative smaller fiber volume.

The bi-directional fabric has in common with cross-plied unidirectional fabrics superior ballistic resistance, but it has in common with conventional woven fabrics, ease and economy of manufacture on conventional machinery.

Comparative Example 4

1200 denier polyethylene yarn designated SPECTRA® 900 (from Honeywell International Inc.), having a tenacity of 30 g/d, initial tensile modulus of 850 g/d, energy-to-break of 40 J/g, breaking strength of 36 Kg and 3.6% elongation at break was woven into a 21×21 ends/inch (8.27 ends/cm) plain weave fabric. Nineteen 18×18 inch (45.7×45.7 cm) squares were cut from the fabric. The squares were stacked together to form a ballistic target without any connection joining the individual squares.

Example 4

The same woven and calendered bi-directional fabric described in Example 1 was cut into thirty-six 18×18 inch (45.7×45.7 cm) squares. The squares are stacked together to form a ballistic target without any connection joining the individual squares.

Example 5

A bi-directional fabric of the invention is woven on an American Iwer Model A2 180 loom. The fabric consists of four yarn sets. The first yarn and second yarn sets each consists of highly oriented, high molecular weight continuous filament polyethylene yarns (SPECTRA®1000 from Honeywell International Inc.) of 1300 denier, having a tenacity of 35 g/d, initial tensile modulus of 1150 g/d, energy-to-break of 45 J/g, breaking strength of 45 Kg and 3.4% elongation at break.

A third yarn set arranged transversely to the first yarn set and interlaced with the yarns of the first set consists of a polyurethane segmented block copolymer elastomeric yarn (DuPont LYCRA® SPANDEX brand) of 1120 denier and having a breaking strength of 0.76 Kg and 535% elongation at break. A fourth yarn set arranged transversely to the second and third yarn sets and interlaced with the yarns of the second and third yarn sets consists of the same elastomeric yarn as that of the third yarn set. The spacing of yarns in each of the four yarn sets in the fabric is 9 ends/in (3.5 ends/cm).

The fabric is cut into thirty-six 18×18 inch (45.7×45.7 cm) squares and stacked together to form a ballistic target without any connection joining the individual squares.

Example 6

A bi-directional fabric of the invention is knitted on a weft inserted, warp knit machine from Liba, Inc. The fabric consists of three yarn sets. The first and second yarn sets each consist of highly oriented high molecular weight continuous filament polyethylene yarn (SPECTRA® 1000 from Honeywell International Inc.) of 1300 denier and having a tenacity of 35 g/d, initial tensile modulus of 1150 g/d, energy-to-break of 45 J/g, breaking strength of 45 Kg and 3.4% elongation at break. The first yarn set and the second yarn set are unidirectionally oriented transverse to one another in separate planes, one above the other. The spacing of yarns in each of the first and second yarn sets in the fabric is 9 ends/in (3.5 ends/cm). A third yarn set consisting of a polyurethane segmented block copolymer (DuPont LYCRA® SPANDEX brand) elastomeric yarn of 1120 denier and having 0.76 Kg breaking strength and 535% elongation at break, is interleaved with both the first and second yarn sets with a tricot stitch.

The fabric is cut into thirty-six 18×18 inch (45.7×45.7 cm) squares and stacked together to form a ballistic target without any connection joining the individual squares.

Example 7

A multi-axial fabric of the invention is knitted on a weft inserted warp knit machine from Liba, Inc. The fabric consists of four continuous filament unidirectional sets of yarns, each in its own plane, and a fifth yarn set interlacing with and binding the unidirectional yarn sets with interlocking loops.

The first yarn and second yarn sets each consist of continuous filament highly oriented high molecular weight continuous filament polyethylene yarns (SPECTRA® 1000 from Honeywell International Inc.) of 1300 denier and having a tenacity of 35 g/d, initial tensile modulus of 1150 g/d, energy-to-break of 45 J/g, breaking strength of 45 Kg and 3.4% elongation at break. The third and fourth yarn sets each consist of continuous filament aramid yarns (KEVLAR® 49 From E.I. Dupont de Nemours & Co,) of 1140 denier and having a tenacity of 28 g/d, initial tensile modulus of 976 g/d, energy-to-break of 25 J/g, breaking strength of 31.9 Kg and 2.9% elongation at break. The fifth interlacing yarn set consists of a partially oriented nylon 6 yarn of 300 denier having a breaking strength of 0.6 Kg and an elongation at break of 40%. The spacing of yarns in each of the unidirectional yarn sets in the fabric is 20 ends/in (7.9 ends/cm).

Referring to the schematic representation of FIG. 3, the first yarn set 31 and the second yarn set 32 are unidirectionally oriented transverse to one another in separate planes, one above the other. The third unidirectional yarn set 33 is at an angle of 45° to yarns in the set 32 immediately below. The fourth unidirectional yarn set 34 is transverse to the yarns in the set 33 immediately below. The fifth yarn set 35 is interlaced with and binds the unidirectional yarn sets with interlocking loops.

The multi-axial fabric is calendered as described in Example 1 and squares are cut from the fabric and stacked together to form a ballistic target without any connection joining the individual squares.

Ballistic Testing

The ballistic resistance of the targets prepared in Comparative Example 4 and Examples 4 to 7 are evaluated according to the National Institute of Justice Standard NIJ 0101.03 using a clay backing and a 9 mm full metal jacketed, 124 grain (8.0 g) projectile. The areal densities of the targets, the velocities at which 50% of projectiles fail to penetrate the targets (V50) and the specific energy absorption of the targets (SEAT) are listed in Table II below.

TABLE II

Ballistic Test Results on Stacked Fabric Targets

| Ex. No. | Fabric Construction | Areal Density, Kg/sq. m | V50, m/sec | SEAT, J-m2/Kg |
|---|---|---|---|---|
| Comp. 4 | Plain Weave | 4.26 | 275 | 72 |
| Ex. 4 | Bi-directional Woven | 4.18 | ≈280 | ≈75 |
| Ex. 5 | Bi-directional Woven | 4.18 | ≈280 | ≈75 |
| Ex. 6 | Bi-directional Knitted | 4.18 | ≈280 | ≈75 |
| Ex. 7 | Multi-axial Knitted | 4.18 | ≈280 | ≈75 |

It is expected that the bi-directional and multi-axial fabrics of the invention provide comparable or better resistance to penetration by a ballistic projectile. Moreover, the fabrics containing the elastomeric yarn are able to conform more readily and comfortably to the wearer when incorporated in soft body armor.

Comparative Example 5

A highly oriented, high molecular weight polyethylene yarn (SPECTRA® 900 from Honeywell International Inc.) was woven into a plain weave fabric of 21×21 ends/in (8.3 end/cm) on an American Iwer Model A2 180 loom. The polyethylene yarn was of 1200 denier and had a tenacity of 30 g/d, initial tensile modulus of 850 g/d, energy-to-break of 40 J/g, breaking strength of 36 Kg and 3.6% elongation at break. One surface of the fabric was coated with a styrene-isoprene-styrene block copolymer elastomer designated KRATON® D1107 having an initial tensile modulus of 200 psi (1.4 MPa). The elastomer was 5% by weight of the coated fabric.

A linear low density polyethylene film having a thickness of 0.00035 inches (8.89 micrometers) was laminated to the elastomeric surface of the fabric by passing the fabric, the polyethylene film and an outer polyester release film through opposed rolls operating at the same speed under a roll pressure of 635 lbs/inch (109 kN/m) at 121° C. The release film was then stripped from the polyethylene-fabric composite. The polyethylene film constituted 3.5 wt. % of the fabric composite.

Nineteen 18×18 inch (45.7×45.7 cm) squares were cut from the fabric composite and were stacked together to form a ballistic target without any connection joining the individual squares. The target areal density was 1.01 lb/sq.ft. (4.94 Kg/sq.m).

Comparative Example 6

A cross-plied unidirectional fabric composite (SPECTRA SHIELD® LCR from Honeywell International Inc.) was cut into 18×18 inch (45.7×45.7 cm) squares. The fabric composite was comprised of highly oriented, high molecular weight polyethylene yarns having a tenacity of 35 g/d, initial tensile modulus of 1150 g/d, energy-to-break of 45 J/g, breaking strength of 45 Kg and 3.4% elongation at break in an elastomeric matrix laminated with a polyethylene film. Twenty-four squares were stacked together to form a ballistic target without any connection joining the individual squares. The target areal density was 0.75 lb/sq.ft (3.66 Kg/sq.m).

Example 8

The same bi-directional woven fabric as described in Example 1 is calendered as described in Example 1 and is impregnated with a styrene-isoprene-styrene block copolymer elastomer designated KRATON® D1107 having an initial tensile modulus of 200 psi (1.4 MPa). The elastomeric matrix is 20% by weight of the fabric composite. The fabric composite is laminated with a 0.0015 in. (38 micrometers) thick biaxially oriented low density polyethylene film on each surface. Thirty-five squares are cut from the laminated fabric composite and stacked together to form a ballistic target without any connection joining the individual squares. The target areal density is 1.05 lb/sq.ft (5.13 Kg/sq.m).

Example 9

The same bi-directional knitted fabric as described in Example 3 is calendered as described in Example 1 and is impregnated with a styrene-isoprene-styrene block copolymer elastomer designated KRATON® D1107 having an initial tensile modulus of 200 psi (1.4 MPa). The elastomeric matrix is 20% by weight of the fabric composite. The fabric composite is laminated with a 0.0015 in. (38 micrometers) thick biaxially oriented low density polyethylene film on each surface. Thirty-five squares are cut from the laminated fabric composite and stacked together to form a ballistic target without any connection joining the individual squares. The target areal density is 1.02 lb/sq.ft (4.98 Kg/sq.m).

Example 10

The same multi-axial fabric described in Example 7 is calendered as described in Example 1 and is impregnated with a styrene-isoprene-styrene block copolymer elastomer designated KRATON® D1107 having an initial tensile modulus of 200 psi (1.4 MPa). The elastomeric matrix is 20% by weight of the fabric composite. The fabric composite is laminated with a 0.0015 in. (38 micrometers) thick biaxially oriented low density polyethylene film on each surface.

Squares are cut from the laminated fabric composite and stacked together to form a ballistic target without any connection joining the individual squares. The target areal density is 1.02 lb/sq.ft (4.98 Kg/sq.m).

Ballistic Testing

The ballistic resistance of the targets prepared in Comparative Examples 5 and 6 and Examples 5 to 9 are evaluated according to the National Institute of Justice Standard NIJ 0101.03 using a clay backing and a 9 mm full metal jacketed, 124 grain (8.0 g) projectile. The areal densities of the targets, the velocities at which 50% of projectiles fail to penetrate the targets (V50) and the specific energy absorption of the targets (SEAT) are listed in Table III below.

TABLE III

Ballistic Results on Stacked Fabric Composites

| Ex. No. | Fabric Construction | Areal Density, Kg/sq. m | V50, m/sec | SEAT, J-m2/Kg |
|---|---|---|---|---|
| Comp. 5 | Plain Weave | 4.94 | 1246 | 117 |
| Comp. 6 | Cross-plied Unidirectional | 3.66 | 1450 | 214 |
| 8 | Bi-directional Woven | 5.13 | ≈1575 | ≈180 |
| 9 | Bi-directional Knitted | 4.98 | ≈1570 | ≈187 |
| 10 | Muti-axial Knitted | 4.98 | ≈1570 | ≈187 |

The bi-directional and multi-axial fabric composites of the invention are expected to have ballistic resistance (SEAT) intermediate to the plain weave fabric composites and the cross-plied unidirectional fabric composites.

Example 11

A bi-directional fabric of the invention is woven on an American Iwer Model A2 180 loom. The fabric consists of four yarn sets. The first and second yarn sets each consists of highly oriented, high molecular weight polyethylene yarns (SPECTRA® 1000 from Honeywell International Inc.) of 1300 denier and having a tenacity of 35 g/d, initial tensile modulus of 1150 g/d, energy-to-break of 45 J/g, breaking strength of 45 Kg and 3.4% elongation at break.

A third yarn set arranged transversely to the first yarn set and interlaced with the yarns of the first set consists of a water soluble polyvinyl alcohol yarn of 100 denier and having a breaking strength of 0.2 Kg and 45% elongation at break. A fourth yarn set arranged transversely to the second and third yarn sets and interlaced with the yarns of the second and third yarn sets is comprised of the same polyvinyl alcohol yarn. The spacing of yarns in each of the four yarn sets in the fabric is 9 ends/in (3.5 ends/cm).

Having thus described the invention in rather full detail, it will be understood that such detail need not be strictly adhered to but that further changes and modifications may suggest themselves to one skilled in the art, all falling within the scope of the invention as defined by the subjoined claims.

What is claimed is:

1. A woven fabric comprising:

a) a first set of continuous filament unidirectional yarns lying in a first plane;

b) a second set of continuous filament unidirectional yarns lying in a second plane above said first plane and arranged transversely to said first set of yarns;

c) a third set of yarns arranged transversely to said first set of yarns and interlaced with said first set of yarns, each yarn of the third set lying above some and below the remaining yarns of said first set;

d) a fourth set of yarns arranged transversely to said second set and said third set of yarns and interlaced with said second and thirds sets of yarns, each yarn of the fourth set lying above some and below the remaining yarns of said second and third sets of yarns;

wherein each of said first and second sets of yarns have tenacity's equal to or greater than about 15 g/d, initial tensile moduli equal to or greater than about 400 g/d and energies-to-break equal to or greater than about 22 J/g as measured by ASTM D2256; and wherein each of said first and second sets of yarns, in proportion to the yarns comprising each of said third and fourth sets of yarns have at least twice the breaking strength, and half the elongation to break.

2. The woven fabric of claim 1, wherein the yarns of said first and second sets are each selected independently from the group consisting of continuous filament highly oriented high molecular weight polyolefins, aramids, polybenzazoles and blends thereof.

3. The woven fabric of claim 1, wherein the yarns of said first and second sets of yarns are each selected independently from the group consisting of continuous filament highly oriented high molecular weight polyethylene, poly (p-phenylene terephthalamide, poly(m-phenylene isophthalamide), poly(benzobisoxazole, poly (benzobisthiazole), poly(benzobisimidazole) and blends thereof.

4. The woven fabric of claim 1, wherein the yarns of said third and fourth sets are each selected independently from the group consisting of polyamide, polyester, polyvinyl alcohol, polyolefin, polyacrylonitrile, polyurethane, cellulose acetate, cotton, wool, and copolymers and blends thereof.

5. The woven fabric of claim 1, wherein the yarns of at least one of said third and fourth sets of yarns is comprised of an elastomeric fiber.

6. The woven fabric of claim 1, wherein the yarns of at least one of said third and fourth sets of yarns is comprised of staple fibers.

7. The woven fabric of claim 1, wherein the yarns of each of said first and second sets of yarns, in proportion to the yarns comprising each of said third and fourth sets of yarns, have at least three times the breaking strength, and one-third the elongation to break.

8. The woven fabric of claim 1, wherein the yarns of each of said first and second sets of yarns, in proportion to the yarns comprising each of said third and fourth sets of yarns, have at least three times the breaking strength, and one-tenth the elongation to break.

9. The woven fabric of claim 1, wherein the spacing of each of said first, second, third, and fourth sets of yarns is independently from about 5 ends/in (1.97 ends/cm) to about 50 ends/in (19.7 ends/cm).

10. The woven fabric of claim 1, wherein the spacing of each of said first second, third, and fourth sets of yarns is independently from about 8 ends/in (3.15 ends/cm) to about 20 ends/in (7.87 ends/cm).

11. The woven fabric of claim 1, wherein said woven fabric has been calendered.

12. A fabric composite comprising a woven fabric having the characteristics as recited in claim 1 embedded in a matrix selected from the group consisting of an elastomeric matrix having an initial tensile modulus less than about 6,000 psi (41.3 MPa) and a rigid matrix having an initial tensile modulus at least about 300,000 psi (2068 MPa) as measured by ASTM D638.

13. The fabric composite of claim 12, wherein said matrix is a rigid matrix having an initial tensile modulus of at least about 300,000 psi (2068 MPa) as measured by ASTM D638, and wherein coated on at least a portion of one surface of said fabric composite is an elastomeric material having an initial tensile modulus less than about 6,000 psi (41.3 MPa) as measured by ASTM D638.

14. The fabric composite of claim 12, wherein the fabric is calendered.

15. The fabric composite of claim 14, wherein a plastic film bonded to at least a portion of one of the surfaces of said fabric composite.

16. The fabric composite of claim 14, wherein an elastomer is coated on at least a portion of at least one surface of said fabric, said elastomer having an initial tensile modulus equal to or less than about 6,000 psi (41.3 MPa), as measured by ASTM D638; and a plastic film is bonded to at least a portion of said elastomer coated surface.

17. A fabric composite comprising a calendered woven fabric having the characteristics as recited in claim 11 with a plastic film bonded to at least a portion of at least one of said fabric surfaces.

18. A ballistically resistant article comprised of a plurality of fabric sheets plied together in a stacked array, wherein at least a majority of said fabric sheets are a woven fabric having the characteristics as recited in claim 1.

19. The ballistically resistant article of claim 18, wherein the fabric has been calendered.

20. The ballistically resistant article of claim 19, wherein at least a portion of said fabric sheets are fabric composite sheets embedded in a matrix selected from the group consisting of an elastomeric matrix having an initial tensile modulus less than about 6,000 psi (41.3 MPa) and a rigid matrix having an initial tensile modulus at least about 300,000 psi (2068 MPa), as measured by ASTM D638.

21. The ballistically resistant article of claim 20, wherein the matrix is a rigid matrix having an initial tensile modulus at least about 300,000 psi (2068 MPa), as measured by ASTM D638, and coated on at least a portion of one surface of said fabric composite sheets is an elastomeric material having an initial tensile modulus less than about 6,000 psi (41.3 MPa), as measured by ASTM D638.

22. The ballistically resistant article of claim 16 or 21 additionally comprising a hard face member selected from the group consisting of a metal, a ceramic, a glass, a metal filled composite, a ceramic filled composite or a glass filled composite.

23. A method of producing a ballistically resistant article comprising the steps of: weaving a fabric with the characteristics as recited in claim 1; and plying sheets of said fabric in a stacked array.

24. A method of producing a ballistically resistant article comprising the steps of: weaving a fabric with the characteristics as recited in claim 11; and plying sheets of said fabric in a stacked array.

25. The method recited in claim 23 or 24 additionally comprising the step of joining said fabric sheets together by joining means.

26. A method of producing a ballistically resistant article comprising the steps of:

a) weaving a fabric with the characteristics as recited in claim 11;

b) embedding the fabric in a matrix selected from the group consisting of an elastomer having an initial tensile modulus less than about 6,000 psi (41.3 MPa) and a rigid resin having an initial tensile modulus at least 300,000 psi (2068 MPa), as measured by ASTM D638, to produce a fabric composite;

d) plying sheets of said fabric composite in a stacked array; and e) bonding and curing said sheets of said fabric composite together to form a unitary article.

27. A method as recited in claim 26 additionally including the step of bonding a plastic sheet to at least a portion of one surface of said fabric composite prior to plying sheets of said fabric composite in stacked array.

28. A method of producing a ballistically resistant article comprising the steps of:

a) weaving a fabric with the characteristics as recited in claim 11;

b) bonding a plastic film to at least a portion of at least one of said fabric surfaces to produce a fabric composite;

c) plying sheets of said fabric composite in a stacked array; and d) bonding said sheets of said fabric composite together to form a unitary article.

29. A method of producing a ballistically resistant article comprising the steps of:

a) weaving a fabric with the characteristics as recited in claim 11;

b) embedding the fabric in a matrix consisting essentially of a rigid resin having an initial tensile modulus at least about 300,000 psi (2068 MPa), as measured by ASTM D638, to produce a fabric composite;

b) applying to the surface of said fabric composite an elastomeric material having a tensile modulus less than about 6000 psi (41.3 MPa), as measured by ASTM D638, to produce an elastomeric coated fabric composite;

c) plying sheets of said elastomeric coated fabric composite in a stacked array; and d) bonding and curing said sheets of said elastomeric coated fabric composite together to form a unitary article.

* * * * *